US005171593A

United States Patent [19]

Doyle

[11] Patent Number: 5,171,593

[45] Date of Patent: Dec. 15, 1992

[54] VENTILATED PRODUCE PACKAGE, AND METHOD OF MAKING THE SAME

[75] Inventor: Joseph S. Doyle, Williamsburg, Va.

[73] Assignee: Eastern Shore Printing Corporation, Ashland, Va.

[21] Appl. No.: 775,416

[22] Filed: Oct. 15, 1991

[51] Int. Cl.[5] ..... B65D 85/34; B65D 71/08; B65B 53/00; B65B 53/02

[52] U.S. Cl. ..... 426/106; 426/396; 426/415; 426/412; 426/419; 206/497; 53/427; 53/441; 53/442

[58] Field of Search ..... 426/106, 396, 412, 415, 426/419; 206/497; 53/427, 441, 442, 462, 463

[56] References Cited

U.S. PATENT DOCUMENTS

| | | | |
|---|---|---|---|
| 1,821,106 | 9/1931 | Milani | 426/419 |
| 3,040,968 | 6/1962 | Long et al. . | |
| 3,067,039 | 12/1962 | Crane . | |
| 3,097,787 | 7/1963 | Schur . | |
| 3,207,300 | 9/1965 | Farmer . | |
| 4,515,266 | 5/1985 | Myers | 426/419 X |
| 4,815,603 | 3/1989 | Harris . | |
| 4,886,372 | 12/1989 | Greengrass et al. . | |
| 4,910,032 | 3/1990 | Antoon, Jr. | 426/415 X |

*Primary Examiner*—Bryon P. Gehman
*Attorney, Agent, or Firm*—Hoffmann & Baron

[57] ABSTRACT

A method of wrapping a tray of produce or other articles requiring ventilation is provided. A ventilated package produced in accordance with the method is also provided. In accordance with the method, a sheet of flexible plastic film is applied to an open ended tray. The sheet includes a perforated portion which is bounded by non-perforated lateral edge portions. The sheet is positioned with respect to the tray such that the perforated portion is located over the open end of the tray while the non-perforated lateral edge portions extend over opposing portions of the rim of the tray and down the side walls thereof. The sheet is stretched in such a manner that the non-perforated lateral edge portions are subject to more severe stretching than the perforated portion of the sheet. The sheet accordingly will not tend to tear despite the presence of perforations.

16 Claims, 4 Drawing Sheets

VENTILATED PRODUCE PACKAGE, AND METHOD OF MAKING THE SAME

BACKGROUND OF THE INVENTION

1. Field of the Invention

The field of the invention relates to produce packages wrapped with a perforated plastic film, and methods for producing such packages.

2. Brief Description of the Prior Art

Plastic film prepackaging of produce such as blueberries and raspberries which have high water content and/or tender stems must provide a free flow of air through the film to help prevent mold growth. Such produce is often packaged in trays or "tills" made of plastic foam, rigid plastic or molded paper pulp. Films wrapped around such trays generally have poor oxygen transmission rates, and the need for perforating the films when used for such applications has accordingly been recognized.

One approach which has been taken for perforating plastic films has been to randomly place perforating needles around a cylinder press, and apply the cylinder to the film during either the printing operation or the wrapping operation. Such an approach has generally resulted in generally ragged perforations which will cause the film to tear as it is stretched over the tray.

Various other approaches have been taken for packaging produce in a manner that adequate ventilation is provided. U.S. Pat. No. 3,067,039 discloses a package including a cover film including slits. The film is secured to prongs extending from the corners of a produce basket.

A wrapping film for use with produce is disclosed by U.S. Pat. No. 3,097,787. The film is vented by pressing it over a toothed roll. It appears to be designed for use in bag form.

U.S. Pat. No. 3,207,300 discloses a transparent web which is provided with a series of pin holes to permit the escape of entrapped air from a package interior during a shrinking process. The method disclosed is said to be applicable to products in bulk form, such as bananas, or partially prepackaged products such as fruit trays.

U.S. Pat. Nos. 3,040,968, 4,815,603 and 4,886,372 disclose various other packaging assemblies or techniques which allow the ventilation of food products.

SUMMARY OF THE INVENTION

It is an object of the invention to provide a package which includes a tray having a perforated film covering to adequately ventilate the contents of the tray.

It is another object of the invention to provide a method for wrapping produce within a tray with a perforated film.

A still further object of the invention is to provide a method of wrapping a tray with perforated film in such a manner that the film does not tear.

In accordance with these and other objects of the invention, a produce package is provided which includes a tray having an open end defined by a rim on the tray and containing produce therein, and a plastic film covering the tray, the plastic film including a large number of microperforations within the rim of the tray and being substantially devoid of microperforations over at least a pair of opposing portions of the rim, the film being stretched over the rim. The plastic film is preferably a generally rectangular sheet including a longitudinal band of microperforations extending between two opposing ends of the sheet. The width of the band is slightly less than the width of the tray so that the portions of the sheet stretched over the lateral portions of the rim are substantially devoid of perforations. The sheet is accordingly unlikely to tear in this area. The portions of the sheet extending over the front and rear edges of the rim are perforated, but subject to less stretching than those portions extending over the lateral edges thereof. These portions are also unlikely to tear despite the presence of perforations as they are not stretched sufficiently to adversely affect the film.

A method of wrapping a tray containing produce or other articles requiring ventilation is also provided by the invention. The method includes the steps of providing an article-containing tray having an open end defined by a rim, a bottom wall, and side walls connecting the rim and bottom wall; providing a sheet of plastic film, the sheet including a perforated portion and a pair of non-perforated portions adjoining the perforated portion, applying the sheet to the tray such that the perforated portion is positioned over the open end of the tray and the nonperforated portions are positioned over opposing portions of the rim, stretching the sheet laterally and folding the non-perforated portions of the sheet over the opposing portions of the rim; and securing the sheet in position. In accordance with a preferred embodiment of the invention, the front and rear portions of the sheet are folded over the rim and tucked under the tray.

DETAILED DESCRIPTION OF THE INVENTION

A method of packaging produce using trays and perforated plastic film is disclosed. The method lends itself to automation through the use of conventional wrapping equipment, such as automatic stretch machines.

Figure 1:
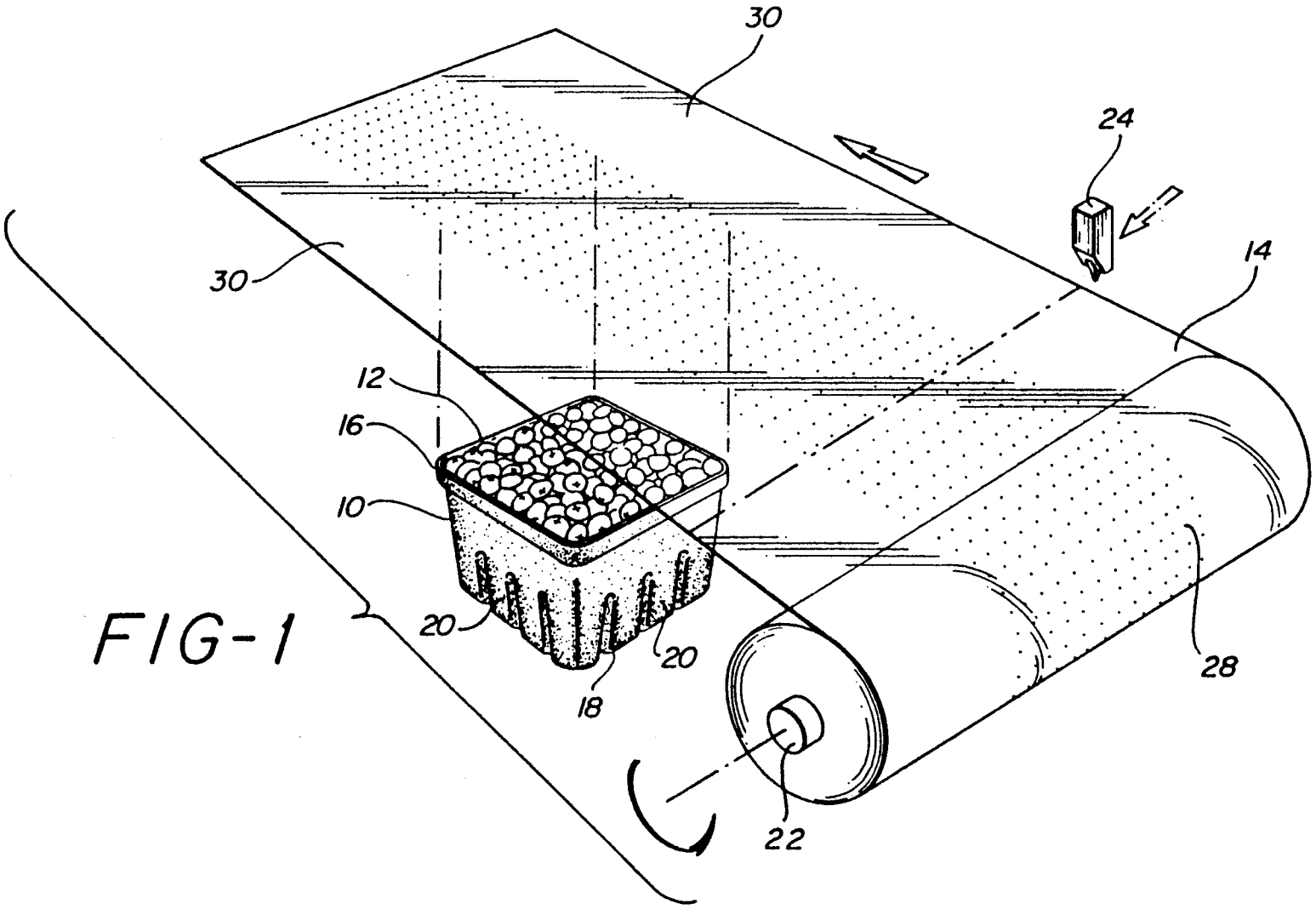
FIG. 1 is a top perspective view of a plastic film moving from a cylinder and above a tray containing produce.

Referring to FIG. 1, a tray 10 filled with blueberries 12 is positioned beneath a web 14 of plastic wrapping film. The tray includes a generally rectangular rim 16, a bottom wall 18, and side walls 20 connecting the rim and bottom wall. The tray is made from molded paper pulp, but may alternatively be constructed from various plastic materials.

The film may be fully transparent, but may also include printed material or other indicia thereon. Stretch or shrink wrap films may be employed depending upon the wrapping equipment available to the packager. The film is preferably provided in web form upon a cylinder 22.

Figure 2:
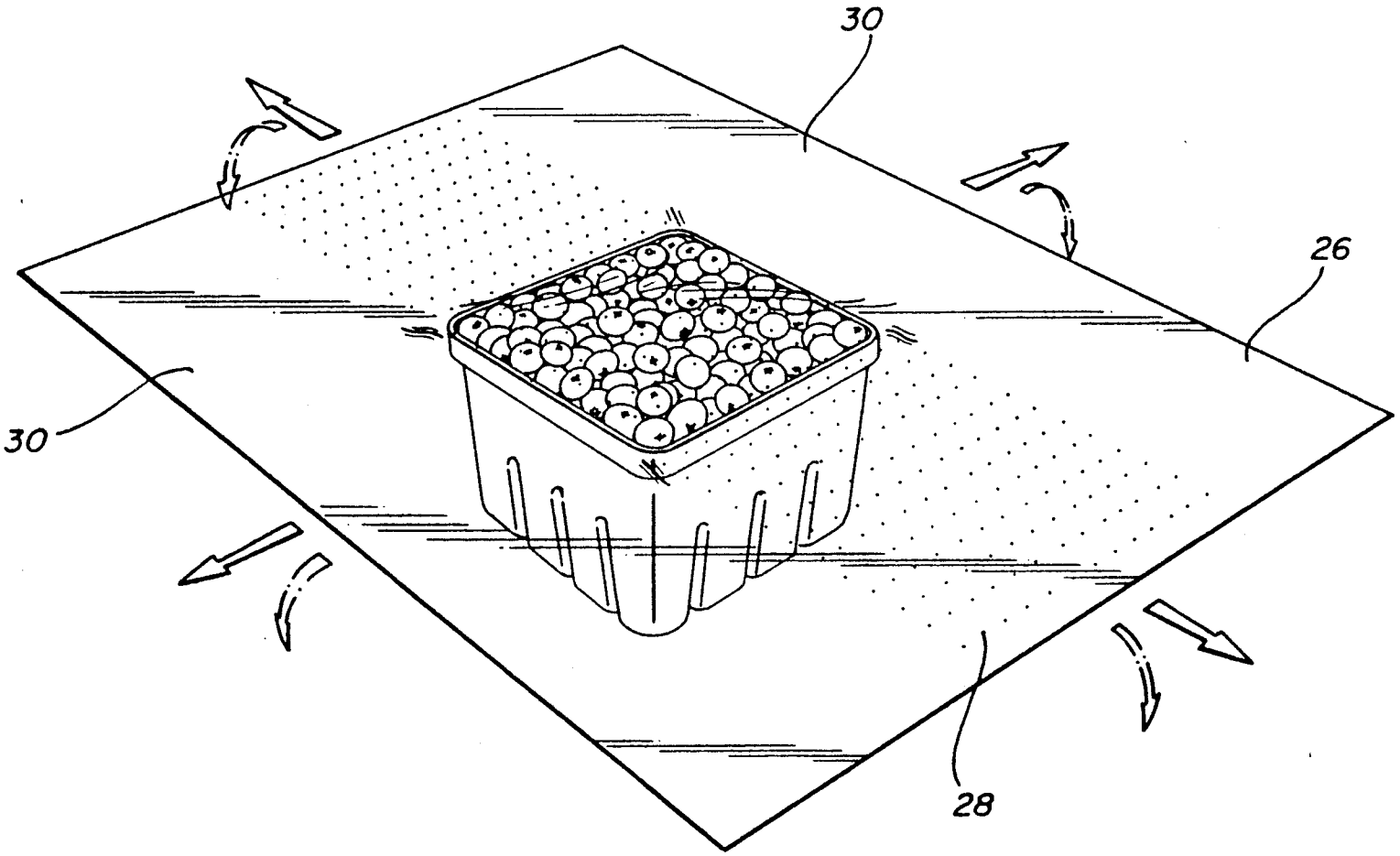
FIG. 2 is a top perspective view of a sheet of plastic film positioned over a tray of produce.

A cutter 24 is provided for cutting the web into individual sheets 26. Such a sheet is shown in FIG. 2. The web 14 includes a centrally positioned band of microperforations 28. When a sheet 26 is separated from the webs by the cutter 24, the sheet will have a longitudinal band of such microperforations extending between the front and rear edges thereof.

The sheet 26, like the web 14, further includes lateral edge portions 30 which extend the length of the sheet on each side of the band of microperforations. Each lateral edge portion is substantially devoid of perforations. The size of the sheet and widths of the band of microperforations and lateral edge portions all depend upon the size of the tray to be wrapped. The sheet should be long enough to allow the front and rear edges thereof to be folded over the opposing rim portions and tucked under the tray. It should also be wide enough that the la&:eral edge portions can be folded over the lateral portions of the rim and tucked under the tray. The width of the band of microperforations is preferably slightly smaller than the width of the tray.

The solid arrows in FIG. 2 indicate the directions in which the sheet is stretched, while the arrows formed in dashed lines indicate the direction the sheet is folded about the tray during a stretch wrapping process. During this process, the lateral edge portions of the sheet engage the lateral portions of the rim and are stretched over the adjoining side walls. The ends thereof are then tucked under the tray. The sheet is also stretched longitudinally as it is wrapped about the front and rear portions of the rim and then tucked under the tray.

It has been found that most of the force exerted on a film during the stretch wrapping process occurs in the areas of the lateral rim portions of the tray, and in the areas outside the lateral rim portions extending down the sides of the tray. The film is stretched relatively severely at these locations and only slightly outside of them. In contrast, much less stretching of the film occurs within the rim of the tray. There is also no severe stretching of the film anywhere in the longitudinal direction. The sheet used in the process provided herein accordingly lacks perforations where stretching is most severe, thereby reducing the possibility of tearing it as the tray is wrapped. Perforations are, however, provided in sufficient number where they are most necessary. The fact that perforated portions of the sheet are folded over the front and rear portions of the rim and adjoining side walls does not tend to result in tears. It accordingly becomes possible to wrap produce trays with perforated film in an automated process without destroying the film.

Figure 3:
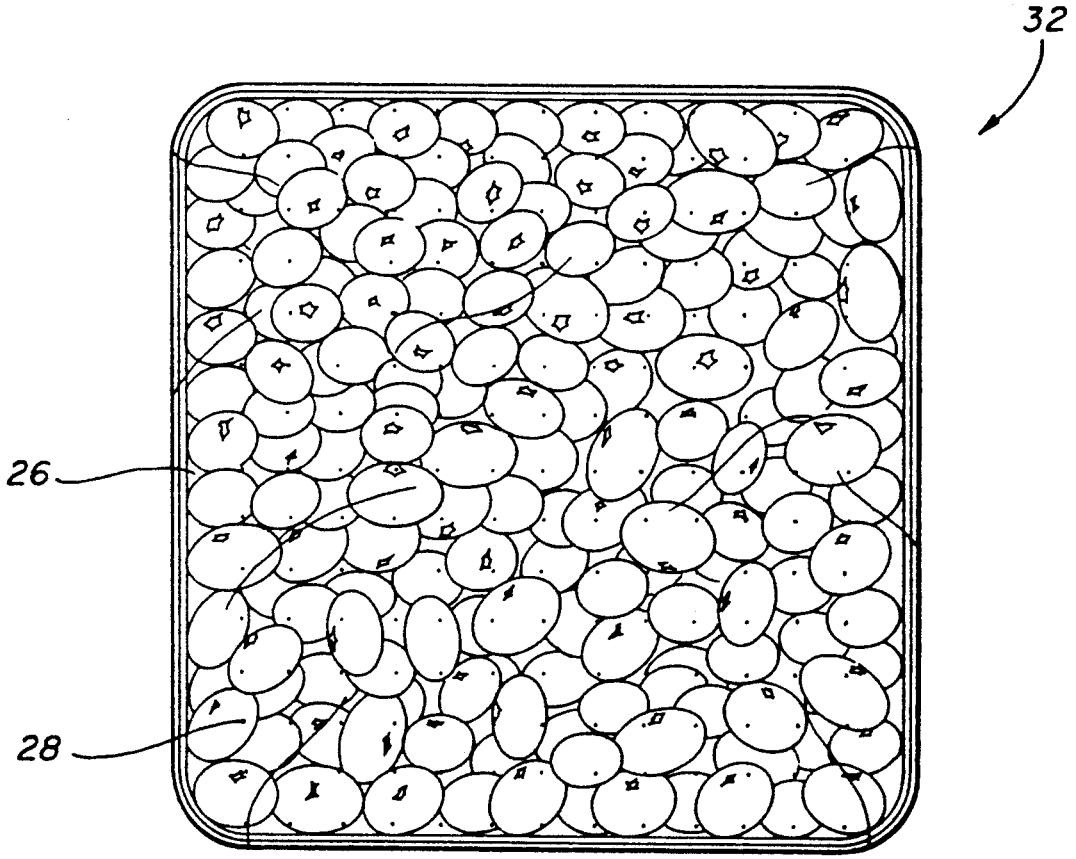
FIG. 3 is a top plan view of a produce package according to the invention.
Figure 4:
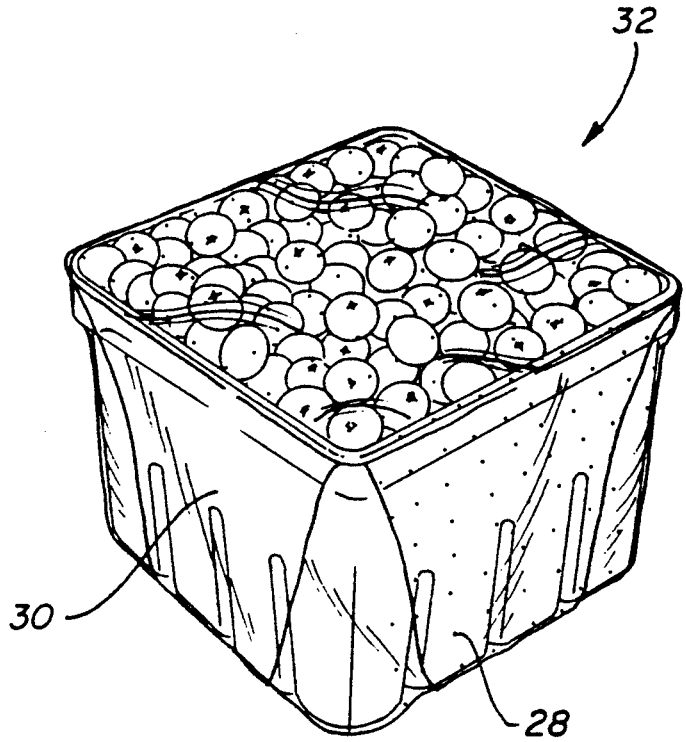
FIG. 4 is a top perspective view thereof.
Figure 5:
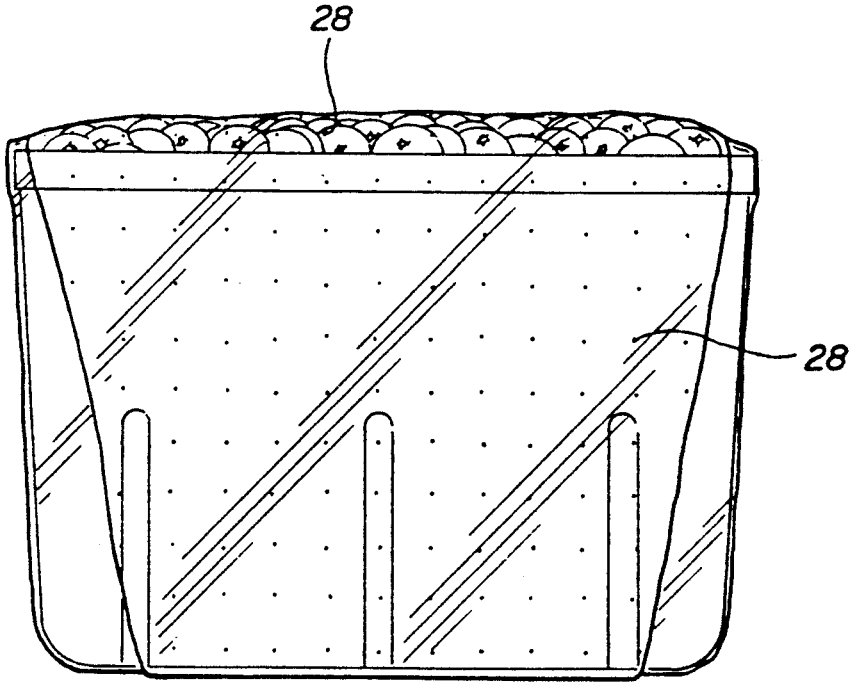
FIG. 5 is a front elevation view thereof.

Once the sheet 26 has been stretched laterally and longitudinally, folded over the rim of the tray 10 and tucked below it, the sheet is secured in position by material cohesion, heat sealing or other suitable means. A package 32 as shown in FIGS. 3–5 is accordingly provided.

The package is assembled so that a large number of microperforations 28 are positioned over the open end of the tray 10. Prior to the stretching of the film about the tray, the microperforations are about the size of pin holes. This size does not increase sufficiently to damage the film as the film is stretched since most of the stretching occurs in the unperforated areas, as described above.

The microperforations 28 are arranged in rows and columns. Microperforations provided at quarter inch centers generally provide satisfactory ventilation. Smaller or larger spacing of the microperforations may be utilized depending upon the size of the tray and the articles stored within the tray. By using quarter inch spacing, about sixteen microperforations are provided per square inch. By providing at least about ten microperforations per square inch, adequate ventilation is provided for most food packaging purposes.

It should also be noted that if several isolation perforations do fall into the area of severe stretching that the package will most likely maintain its integrity. A pattern of microperforations as described would cause severe tearing in this area, making the wrapping sheet useless.

Microperforations are preferably employed when stretch wrapping films are used to wrap a tray. Such perforations are less likely to tear than larger perforations as lateral and longitudinal forces are exerted upon the film.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A ventilated produce package comprising:

a tray having an open end defined by a rim, said tray containing produce; and a flexible plastic film substantially covering said tray, said plastic film extending over the open end of said tray and including a large number of microperforations within the rim of said tray, said plastic film being relatively severely stretched over a first pair of opposing portions of the rim of said tray and being substantially devoid of microperforations and outside said first pair of opposing rim portions aid plastic film being less severely stretched over a second pair of opposing portions of the rim of said tray, said plastic film including microperforations outside said second pair of opposing rim portions.

2. A produce package as described in claim 1, wherein said plastic film is a stretch film.

3. A produce package as described in claim 2, wherein said rim has a generally rectangular configuration.

4. A produce package as described in claim 3, wherein said plastic film includes a band of microperforations extending the length thereof and a pair of lateral edge portions extending the length of said plastic film and being substantially devoid of perforations, the band of perforations extending across the rim of said tray and over the second pair of opposing portions of the rim, the lateral edge portions of the film bounding the band of perforations and extending, respectively, over the first pair of opposing portions of said rim.

5. A produce package as described in claim 4, wherein at least about ten microperforations per square inch are provided within said plastic film over the open end of said tray.

6. A produce package as described in claim 5, wherein said tray includes first and second pairs of side walls adjoining, respectively, the first and second pairs of opposing portions of the rim, the lateral edge portions of the film extending over the first pair of side walls and the band of perforations extending over the second pair of side walls.

7. A produce package as described in claim 6, wherein said plastic film is tucked beneath said tray.

8. A produce package as described in claim 4, wherein said tray includes first and second pairs of side walls adjoining, respectively, the first and second pairs of opposing portions of the rim, the lateral edge portions of the film extending over the first pair of side walls and the band of perforations extending over the second pair of side walls.

9. A method of wrapping a tray of articles requiring ventilation, comprising:

providing a tray having articles requiring ventilation therein, said tray including an open end defined by a rim, a bottom wall, and side walls connecting the rim and bottom wall;

providing a sheet of flexible plastic film, the sheet including a perforated portion and a pair of non-perforated portions adjoining the perforated portion;

applying the sheet to the tray such that the perforated portion is positioned over the open end of the tray and the non-perforated portions are positioned, respectively, over a first pair of opposing portions of the rim and extend outside the first pair of opposing portions of the rim;

stretching the sheet and folding the nonperforated portions of the sheet over the first pair of opposing portions of the rim such that the non-perforated portions of the sheet are subject to more severe stretching than the perforated portion of the sheet; and securing the sheet in position upon the tray.

10. A method as described in claim 9, including the step of stretching the sheet in two orthogonal directions.

11. A method as described in claim 10, wherein the sheet includes front and rear edge portions, and lateral edge portions defined by the non-perforated portions of the sheet, including the step of folding the longitudinal edge portions over a second pair of opposing portions of the rim.

12. A method as described in claim 11, wherein the perforated portion extends between the front and rear edge portions of the sheet, including the steps of folding the sheet such that the perforated portion extends across the open end of the tray and down two opposing side wall portions thereof.

13. A method as described in claim 12, wherein the lateral edge portions of the sheet extend between the front and rear edge portions thereof, including the steps of tucking the lateral edge portions at least partially beneath the bottom wall of the tray.

14. A method as described in claim 9, including the step of providing a web of flexible plastic film, the web including a perforated portion bounded by a pair of substantially unperforated lateral edge portions, wherein the step of providing a sheet of flexible plastic film includes making a lateral cut across the web, thereby severing a sheet therefrom.

15. A method as described in claim 9, wherein the width of the perforated area of the sheet is sufficiently smaller than the distance between the first pair of opposing portions of the rim that the perforated portion remains within the first opposing portions of the rim even when the sheet is stretched.

16. A method as described in claim 9, whereins aid articles are produce.

* * * * *